US005775145A

United States Patent [19]

Kasper

[11] Patent Number: 5,775,145

[45] Date of Patent: Jul. 7, 1998

[54] LOCK ASSEMBLY HAVING A KEY OPERATED REMOVABLE PLUG

[75] Inventor: Kazmier J. Kasper, Hopkinton, Mass.

[73] Assignee: Algonquin Industries, Inc., Bellingham, Mass.

[21] Appl. No.: 596,967

[22] Filed: Feb. 5, 1996

[51] Int. Cl.[6] ..... E05B 33/00

[52] U.S. Cl. ..... 70/367; 70/368; 70/369; 70/379 R; 70/380

[58] Field of Search ..... 70/367–369, DIG. 57, 70/79, 80, 379 R, 379 A, 380, 370, 371

[56] References Cited

U.S. PATENT DOCUMENTS

| | | | |
|---|---|---|---|
| 2,008,668 | 7/1935 | Gold | 70/368 |
| 2,595,473 | 5/1952 | O'Connor | 70/79 |
| 2,740,284 | 4/1956 | Gray | 70/79 |
| 2,852,926 | 9/1958 | Chervenka | 70/79 |
| 2,953,011 | 9/1960 | Sitler | 70/80 |
| 3,400,562 | 9/1968 | Bloss | 70/70 |
| 3,410,123 | 11/1968 | Jacobi | 70/368 |
| 3,722,240 | 3/1973 | Spain et al. | 70/378 X |
| 4,007,613 | 2/1977 | Gassaway | 70/DIG. 57 X |
| 4,539,828 | 9/1985 | Teleky | 70/369 |
| 4,635,455 | 1/1987 | Oliver | 70/378 X |
| 5,104,164 | 4/1992 | Sieg | 70/369 X |

FOREIGN PATENT DOCUMENTS

| | | | |
|---|---|---|---|
| 4008649 | 9/1991 | Germany | 70/368 |

*Primary Examiner*—Lloyd A. Gall
*Attorney, Agent, or Firm*—Kriegsman & Kriegsman

[57] ABSTRACT

A lock assembly is provided which includes a shell having a front end, a rear end, and a central bore extending from the front end to the rear end. The lock assembly also includes a key operated plug axially aligned and rotatably and removably disposed within the central bore of the shell. The lock assembly further includes a cam module rotatably mounted on the rear end of the shell. A key is provided which is insertable into the plug and allows for the removal of the plug from the shell. When the key operated plug is removed from the shell, a tool can be inserted through the central bore in the shell and into the cam module for rotationally moving the cam module relative to the shell, thereby unlocking the lock assembly.

3 Claims, 16 Drawing Sheets

LOCK ASSEMBLY HAVING A KEY OPERATED REMOVABLE PLUG

BACKGROUND OF THE INVENTION

The present invention relates generally to a lock assembly and more particularly to a lock assembly of the type which includes a key operated plug removably mounted in a shell.

Lock assemblies which include a key operated plug removably mounted in a shell are well known in the art and widely used in high security applications such as in vending machines, currency changers, automatic bank tellers and so forth where it is desirable to lock a door in a cabinet or a box or other device. These lock assemblies are usually part of a double lock type arrangement which includes a bolt or screw positioned behind and spaced from the shell and mounted on some type of plate. In the operation of such a lock assembly, after the plug has been removed, a screwdriver or wrench is inserted through the bore in the shell to unscrew the bolt or screw. Once unscrewed, the door can be opened. This unscrewing is time consuming. Also, the unscrewing is fairly easy to do once the plug has been removed since only a simple screwdriver or wrench is required.

SUMMARY OF THE INVENTION

It is an object of the present invention to provide a new and improved lock assembly.

It is another object of the present invention to provide a new and improved cabinet.

It is yet another object of the present invention to provide a new and improved locking system.

It is still another object of the present invention to provide a new and improved lock assembly of the type having a shell and a removable plug.

It is yet still another object of the present invention to provide a new and improved hinge assembly for connecting a door to a wall of a cabinet.

It is a further object of this invention to provide a locking system that is difficult to pick.

Accordingly, there is provided a lock assembly comprising a shell having a front end, a rear end, and a central bore extending from the front end to the rear end, a key operated plug axially aligned and rotatably and removably disposed within the central bore of said shell, a cam module rotatably mounted on the rear end of the shell, a key insertable into said plug for removing said plug from said shell, and a tool insertable through the central bore in said shell when said key operated plug is removed from said shell for rotationally engaging and moving said cam module relative to said shell.

According to one feature of the invention, the cam module includes a movable bracket for restricting rotational movement of the cam module relative to the shell.

According to another feature of the invention, there is provided a cabinet comprising a housing having a wall, a door, a hinge assembly for hingedly connecting said door to said wall and a locking system for locking said door in a closed position, said locking system including a lock assembly, said lock assembly comprising a shell having a front end, a rear end, and a central bore extending from the front end to the rear end, a key operated plug axially aligned and rotatably and removably disposed within the central bore of said shell, a cam module rotatably mounted on the rear end of the shell, a key insertable into said plug for removing said plug from said shell, a tool insertable through the central bore in said shell when said key operated plug is removed from said shell for engaging and rotationally moving said cam module relative to said shell, a latch fixedly mounted in said door, a movable plate having a slot and a bracket assembly for connecting said lock assembly to said movable plate having a slot.

According to still another feature of this invention there is provided a hinge assembly for connecting a door to a wall, the hinge assembly comprising a hinge having two leaves, both leaves being fixedly secured to the door and a bracket connected at one end to one of the leaves and at the other end to the wall.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration of an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts:

FIG. 1(*a*) is a section view of the lock shown in FIG. 1, but assembled;

FIG. 1(*b*) is an exploded perspective view of the cam module shown in FIG. 1;

FIG. 5(*a*) is a side view of the plug and tool shown in FIG. 1, illustrating the size of the plug relative to the tool;

DETAILED DESCRIPTION OF A PREFERRED EMBODIMENT

Figure 1:
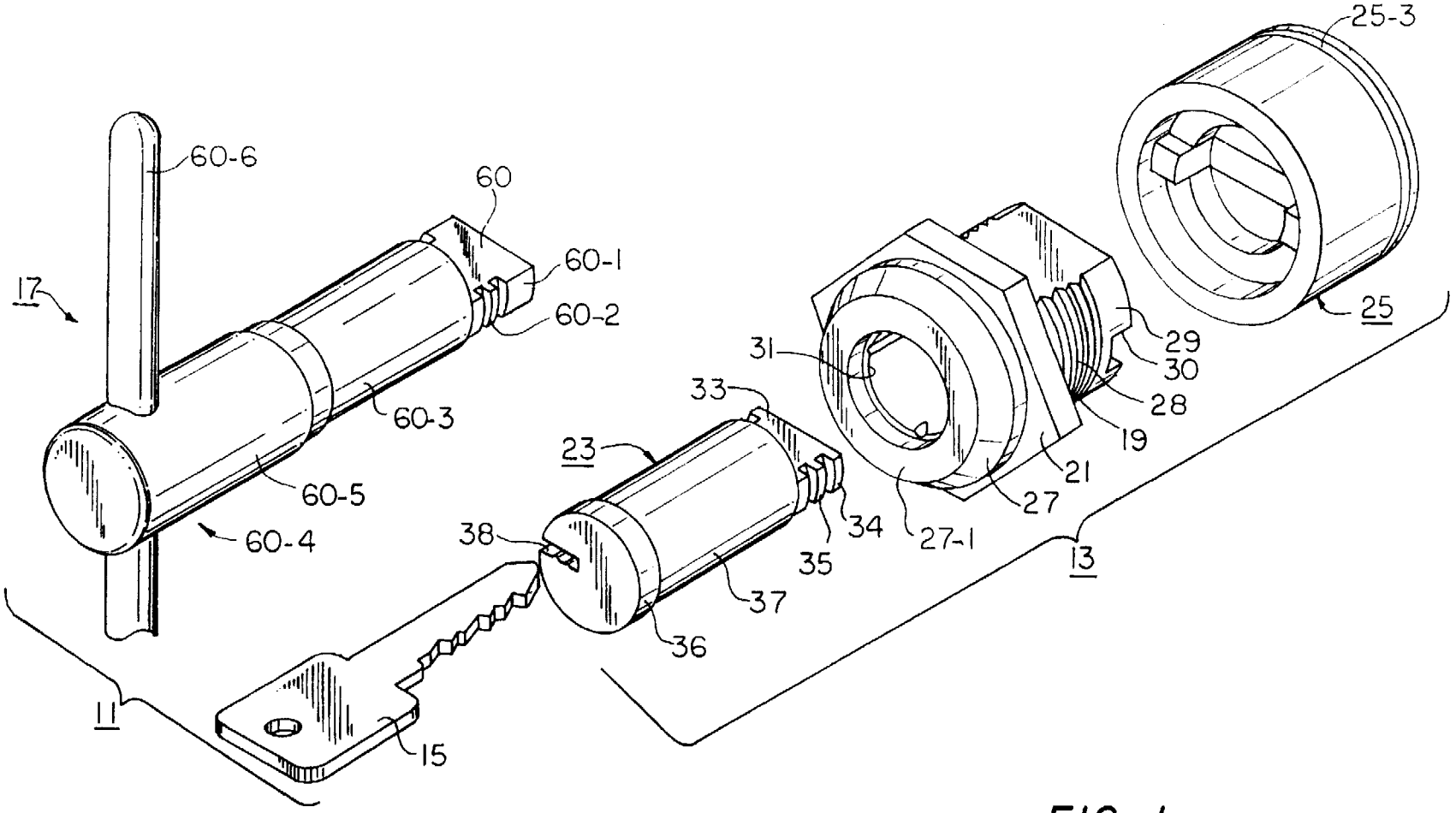
FIG. 1 is an exploded perspective view of a lock assembly constructed according to the teachings of the present invention, the lock assembly including a key, a tool and a lock, the lock including a plug, a shell and a cam module.
Figure 1B:
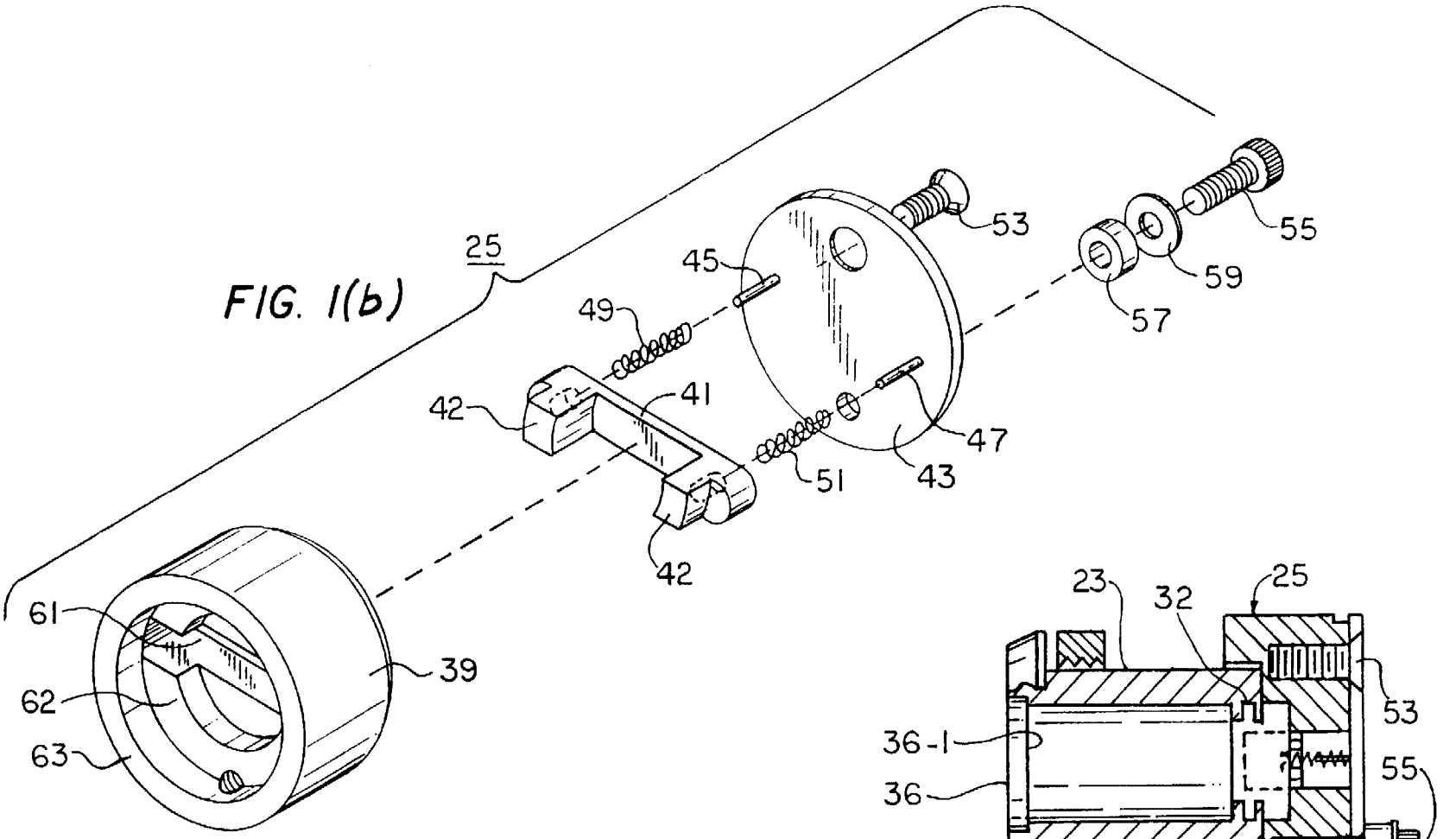
Figure 1A:
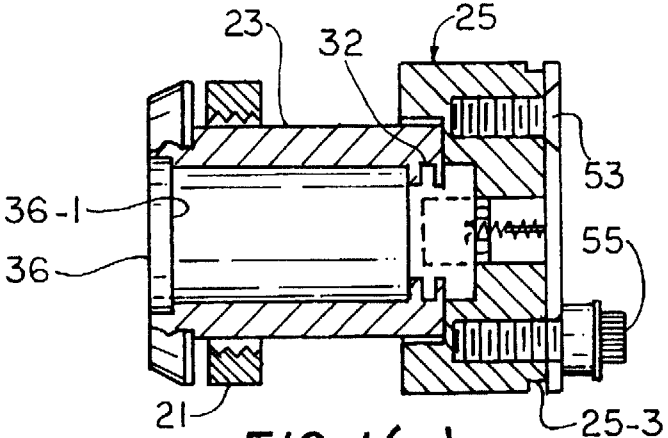

Referring now to the drawings, and first to FIG. 1, there is shown a lock assembly constructed according to the teachings of the present invention, the lock assembly being represented generally by reference numeral 11.

Lock assembly 11 includes a lock 13, a key 15 and a tool 17.

Lock 13, which is also shown in section view in assembled form in FIG. 1(*a*), includes a shell 19, a nut 21, a key operated plug 23 and a cam module 25. Cam module 25 is also shown in exploded perspective view in FIG. 1(*b*).

Key 15 is used to rotate plug 23 in shell 19 between a locked position where plug 23 cannot be removed from shell 19 and an unlocked position where plug 23 can be removed from shell 19 and also to remove plug 23 from shell 19. Tool 17 is used to rotate cam module 25 relative to shell 19 for a purpose to be subsequently explained.

Shell 19 is a generally cylindrical member having a front end 27, an externally threaded main body portion 28, a rear end 29 which includes a lateral slot 30, a central bore 31 extending from front end 27 to rear end 29 and an internal groove 32 on central bore 31 at rear end 29.

Nut 21 is sized to screw onto main body portion 28 of shell 19 and is used to secure shell 19 to the wall of a cabinet on which it is to be mounted, as will hereinafter be explained.

Plug 23 is a generally cylindrically shaped member having a generally rectangular shaped front end 33 which includes a pair of ridges 34 and 35, a rear end 36, a main body portion 37, and a keyway 38, keyway 38 extending from one end of plug 23 to the other. Plug 23 is sized and shaped so that it can be axially aligned and rotatably and removably mounted in bore 31 of shell 19. Front end 33 of plug 23 is sized so that it can extend up into lateral slot 30 in shell 19.

Plug 23 is loaded into shell 19 in the following manner. First, key 15 is inserted into keyway 38. Then, plug 23 is pushed into bore 31 in shell 19 until surface 36-1 of rear end 36 is adjacent surface 27-1 on front end 27 of shell 19. When so positioned, front end 33 will be in slot 30 of shell 19 and ridge 35 aligned with internal groove 32. Plug 19 is then rotated 90 degrees using key 15, locking plug 23 inside shell 19 with ridge 35 in groove 32. Key 15 is then removed. The procedure is reversed to remove plug 23 from shell 19. Key 15 cannot be withdrawn from plug 23 unless plug 23 is locked in shell 19.

Plug 23 and key 15 may be a plug, key combination such as shown in U.S. Pat. No. 4,635,455.

Cam module 25 includes a cam module base 39, a cam module bracket 41, a cam module cover plate 43, a pair of pins 45 and 47, a pair of springs 49 and 51, a pair of bolts 53 and 55, a bearing 57 and a washer 59.

Bracket 41 has a main body portion 41-1 and a pair of feet 42.

Tool 17 has a front end 60 having a pair of ridges 60-1 and 60-2, a main body portion 60-3 and a handle 60-4 which includes a body 60-5 and a bar 60-6.

Cam module base 39 is rotatably and slidably mounted on front end 30 of shell 19 and includes a lateral slot 61. Pins 45 and 47 are fixedly mounted on cam module cover plate 43 which is fixedly attached to cam module base 39 by bolts 53 and 55. Bracket 41 is seated on pins 45 and 47 and is slidably movable in slot 61. Springs 49 and 51 on pins 45 and 47 urge bracket 41 backward so that feet 42 project out of slot 61 beyond surface 62 on module 39, as shown in FIG. 1. A stop 63 on base 39 limits slidable movement of base 39 on front end 29 of shell 19. As long as feet 42 of bracket 41 extend out of slot 61 beyond surface 62 of base 39, cam module 25 cannot be rotated relative to shell 19. However, tool 17 is sized so that when it is inserted into and through shell 19 it will hit up against bracket 41 and, then, when tool 17 is pushed in further it will push bracket 41 back against the action of springs 49 and 51 so that feet 42 do not project up slot 61 beyond surface 62. When bracket 41 is so positioned, cam module 25 can be easily rotated relative to shell 19 by simply turning tool 17.

Figure 5:
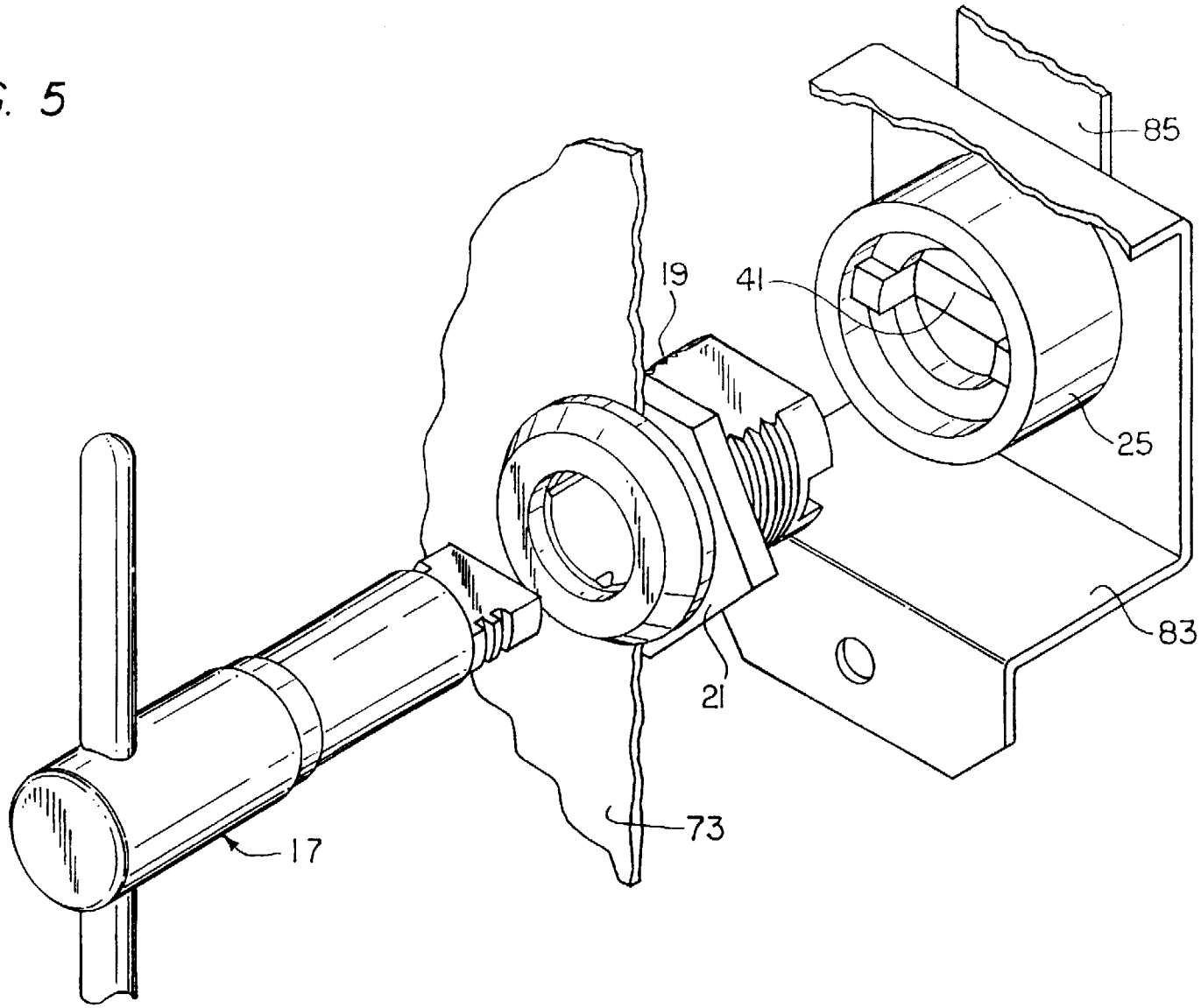
FIG. 5 is a partly exploded perspective view of the shell, cam module and key in FIG. 1 and related structure.
Figure 5A:
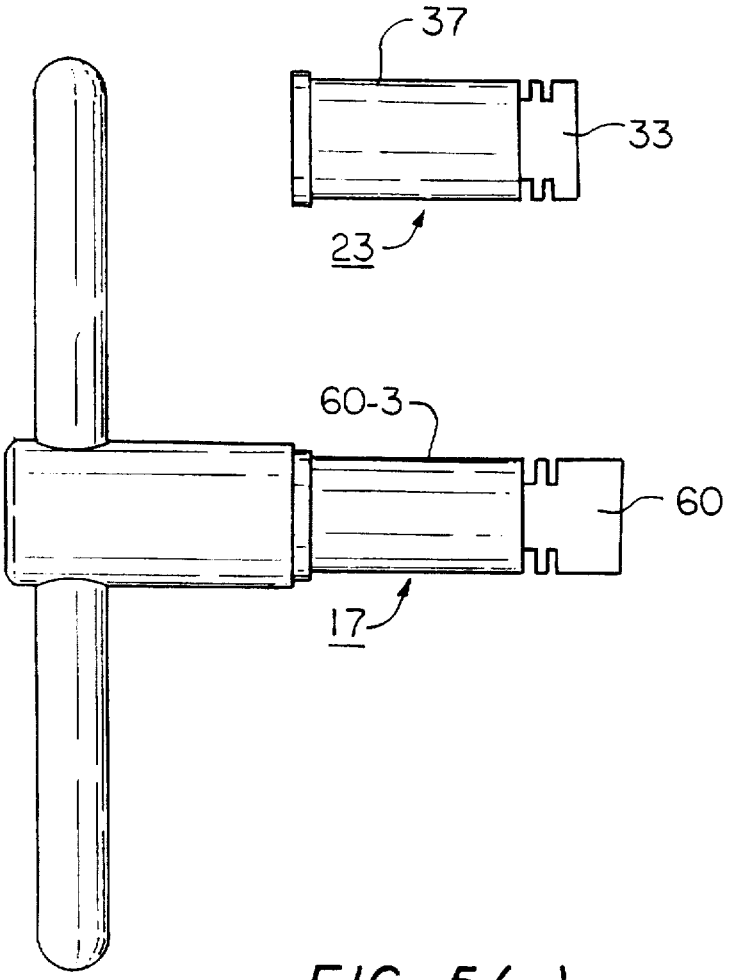
Figure 6:
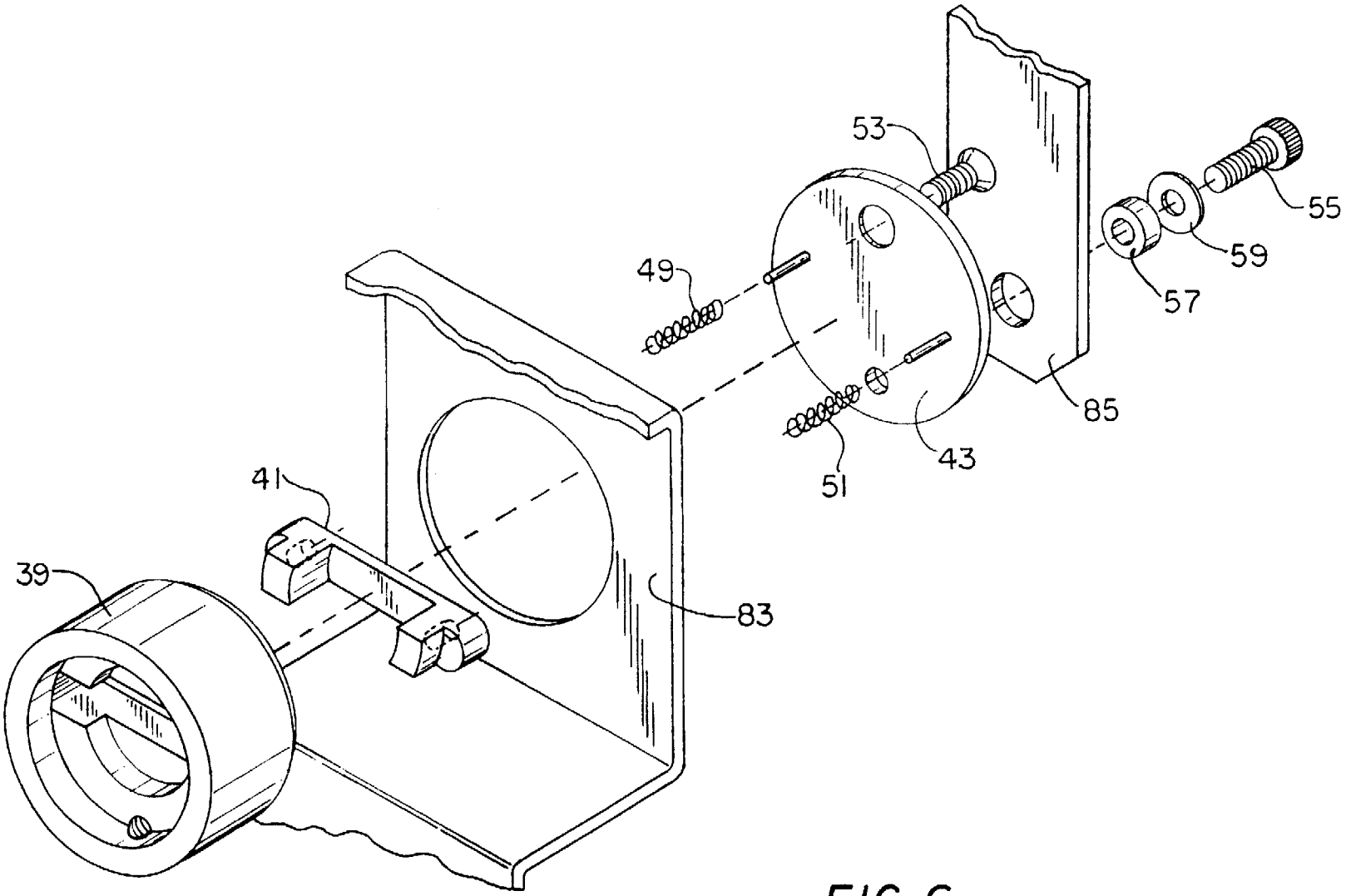
FIG. 6 is an exploded perspective view of the cam module in FIG. 1 and related structure.
Figure 7:
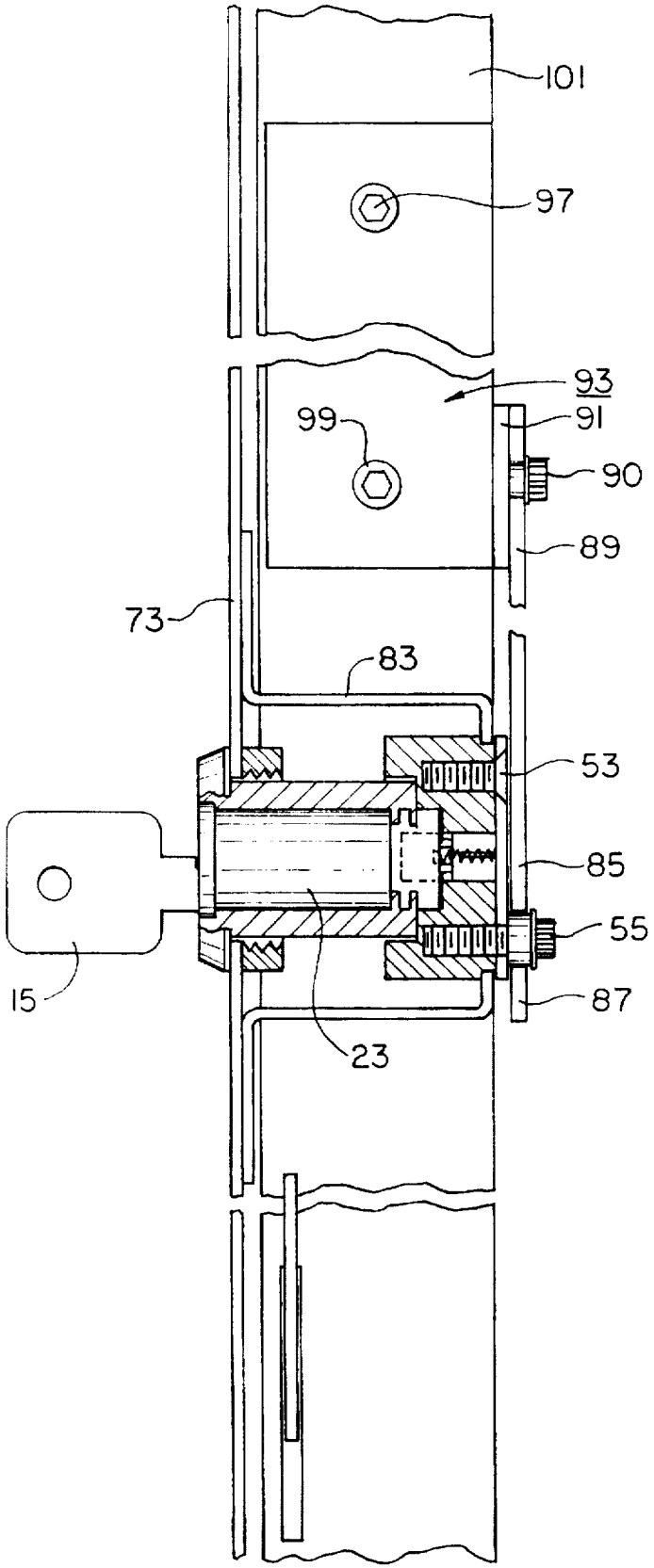
FIG. 7 is a view, partly in section, showing the shell and cam module in the lock assembly in FIG. 1 as mounted on the cabinet, with the plug in the shell and the key in the plug.
Figure 8:
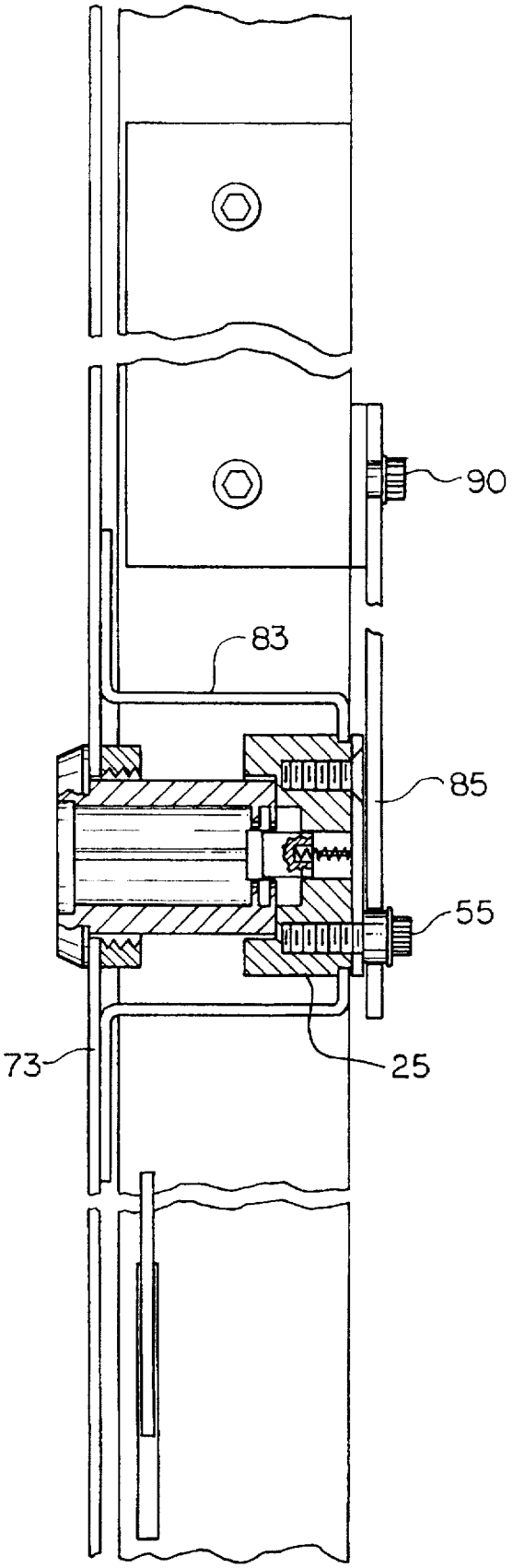
FIG. 8 is a view as shown in FIG. 7, after the plug inside the shell has been removed.

As can be seen in FIG. 5(*a*), the front end 60 of tool 17 is longer than the front end 33 of plug 23, while the front body portion 60-3 of tool 17 is identical to main body portion 37 of plug 23. Consequently, when plug 23 is inserted in shell 19, front end 33 will not hit up against bracket 41 thus tool 17 is the only way bracket 41 can be pushed back so that cam module can be rotated.

Figure 2:
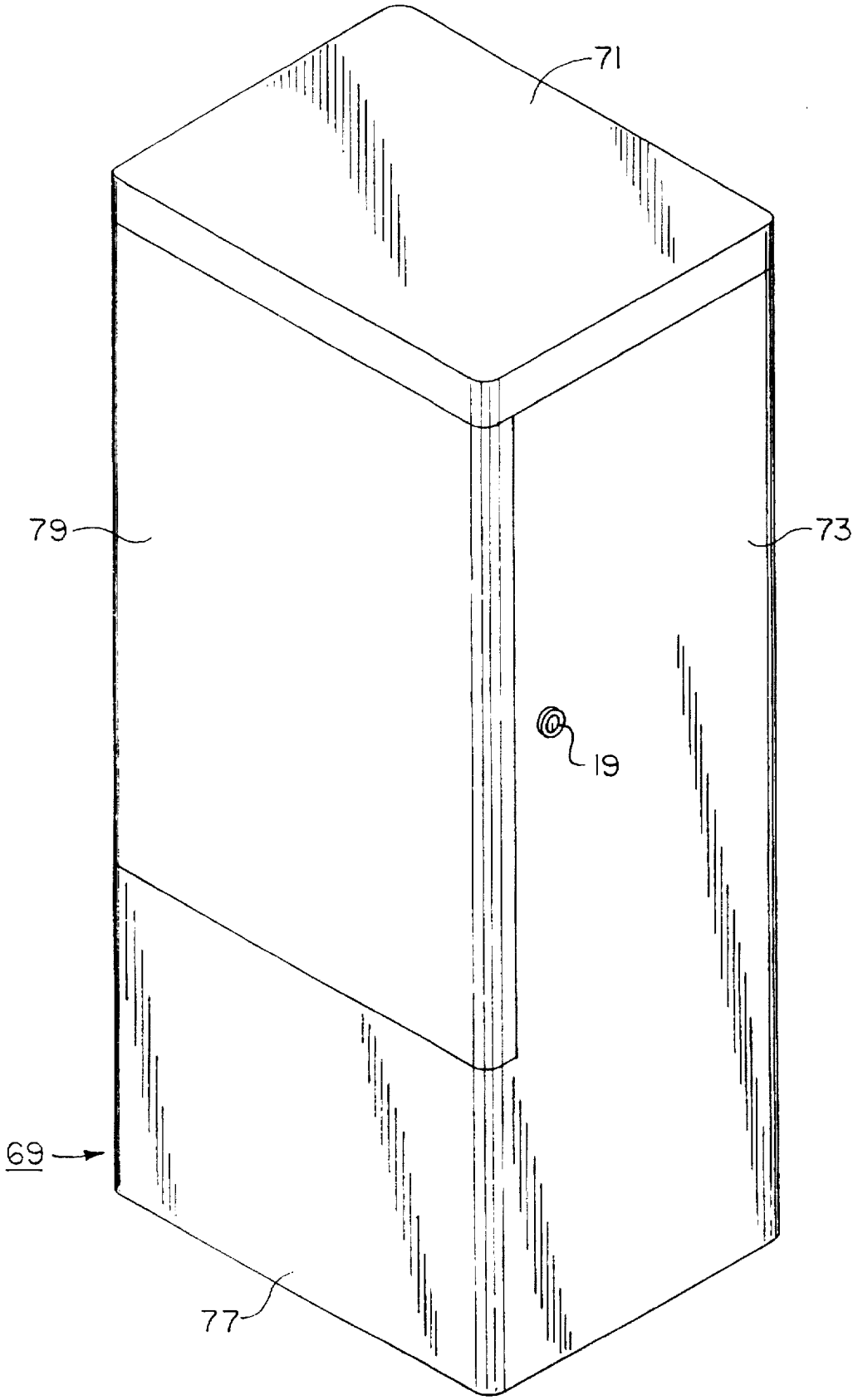
FIG. 2 is a perspective view of a cabinet constructed according to the teachings of the present invention, the cabinet including a door and the lock of FIG. 1 for locking the door, the door being in a closed position.
Figure 3:
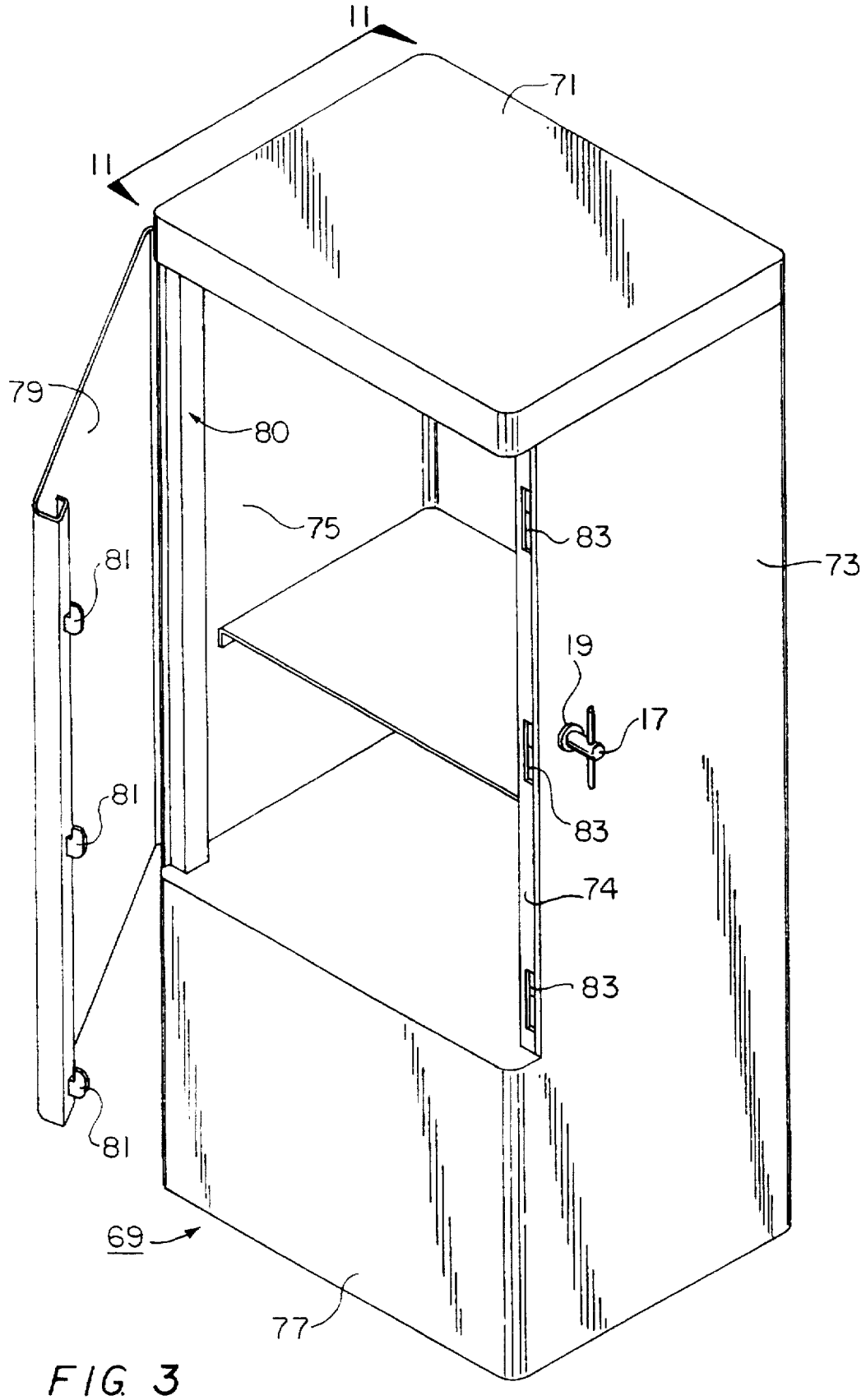
FIG. 3 is a perspective view of the cabinet shown in FIG. 2, but with the door in an open position and the tool in FIG. 1 in the shell of the lock in FIG. 1.

Referring now to FIGS. 2 and 3, there is shown a cabinet 69 constructed according to this invention and identified by reference numeral 69.

Cabinet 69 includes a top 71, a pair of side walls 73 and 75, a front wall 77 and a door 79. Door 79 is attached to side wall 75 by a hinge assembly 80. In FIG. 2, door 79 is closed while in FIG. 3, door 79 is open. Hinge assembly 80 includes a butt hinge 80-1 having a pair of leaves 80-2 and 80-3 and a bracket 80-4 having a pair of legs 80-5 and 80-6 Leaf 80-3 is fixedly secured to door 79. Leg 80-5 is fixedly secured to wall 75 and leg 80-6 is fixedly secured to leaf 80-2.

Figure 4:
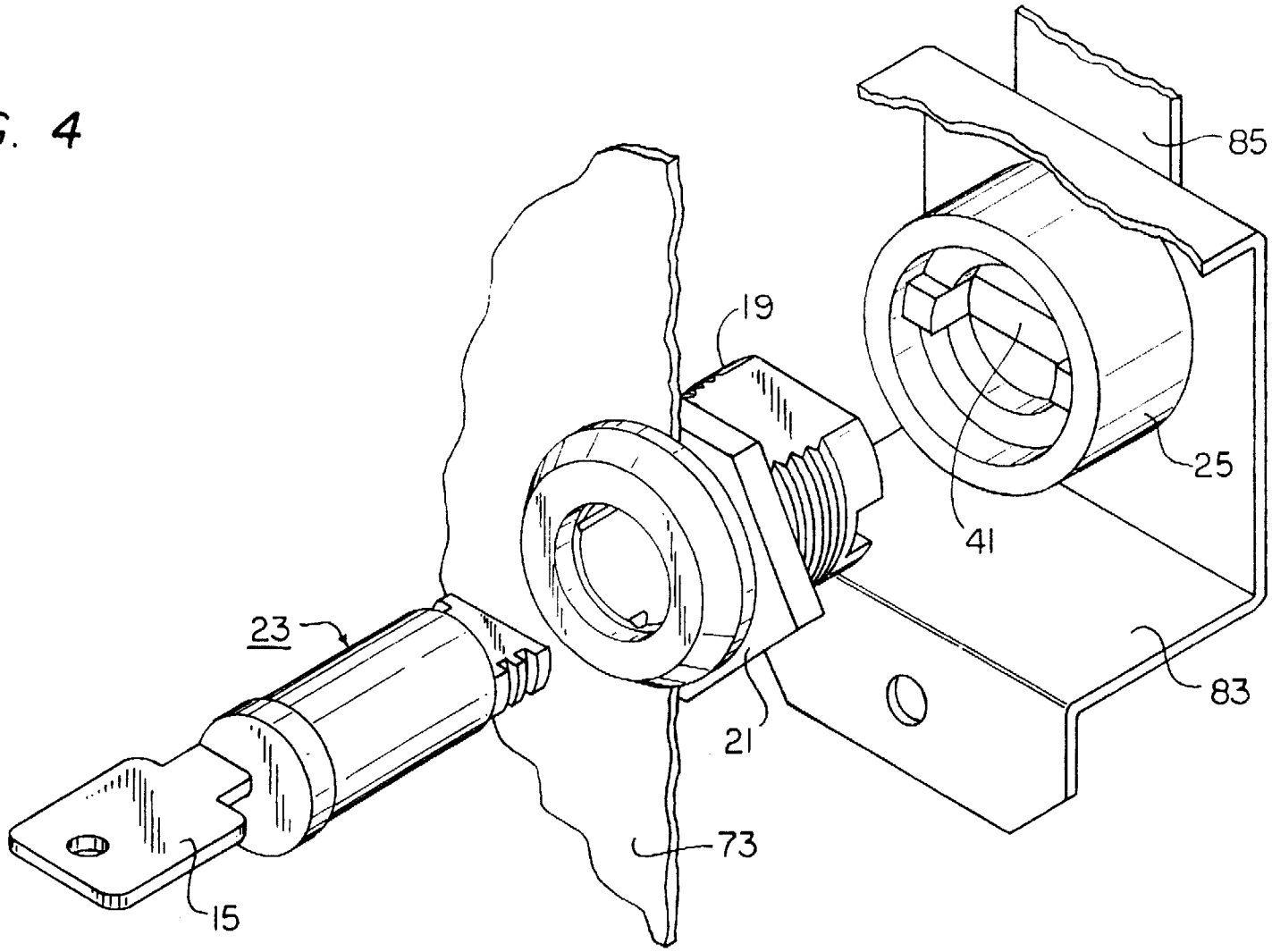
FIG. 4 is a partly exploded perspective view of the lock and key in FIG. 1 and related structure.

Shell 19, as can be seen for example in FIG. 4, is mounted in a hole provided in side wall 73 and held securely in place by nut 21.

Door 79 includes a plurality of latches 81. Each latch 81 includes a hook 81-1 and a mounting plate 81-2. Hooks 81-1 extend out through slots 81-3 in door 79. Mounting plates 81-2 are fixedly secured to door 79 by 82. Side wall 73 of cabinet 69 includes a flange 74 having a plurality of slots 83.

A first bracket 85 is pivotally mounted at one end 87 to cam module 25 by bolt 55 which extends through bearing 57 which is seated in a hole 86 in bracket 85. The other end 89 of bracket 85 is pivotally attached by a bolt 90 to a leg 91 of a second bracket 93. Main body portion 95 of bracket 93 is fixedly attached by bolts 97 and 99 to a slidably mounted elongated bracket 101 having slots 102. When door 79 is closed, hooks 81-1 of latches 81 extend through slots 83 and slots 102.

Cam module 25 is rotationally mounted on a bracket 25-1 which is fixedly secured to side wall 73 by any suitable means, such as welding. Center part 25-2 of bracket 25-1 rides in a groove 25-3 formed in cam module 25 so that bracket 83 does not interfere with rotational movement of cam module 25 relative to shell 19 when tool 17 is turned.

Figure 11:
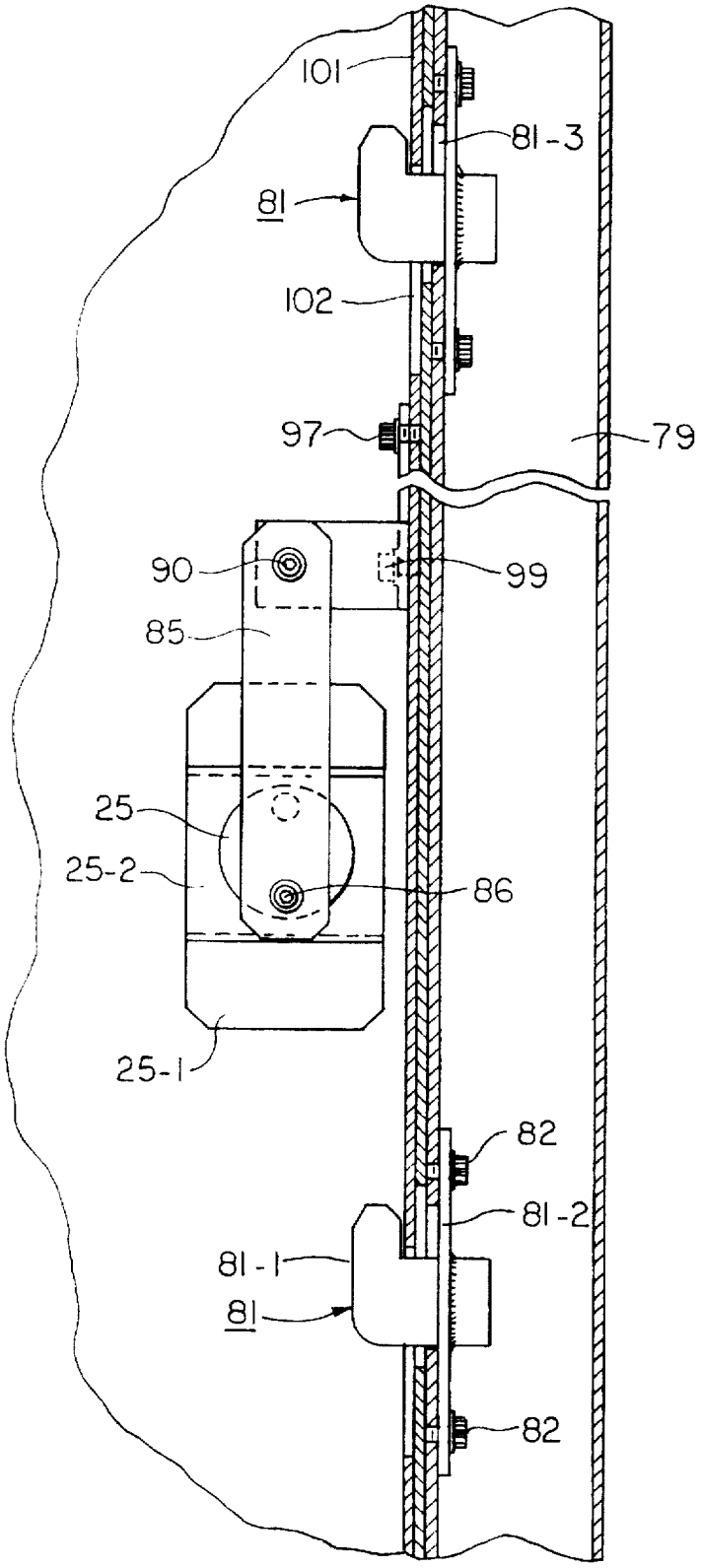
FIG. 11 is a section view, broken away in part, taken along lines 11—11 in FIG. 3.
Figure 12:
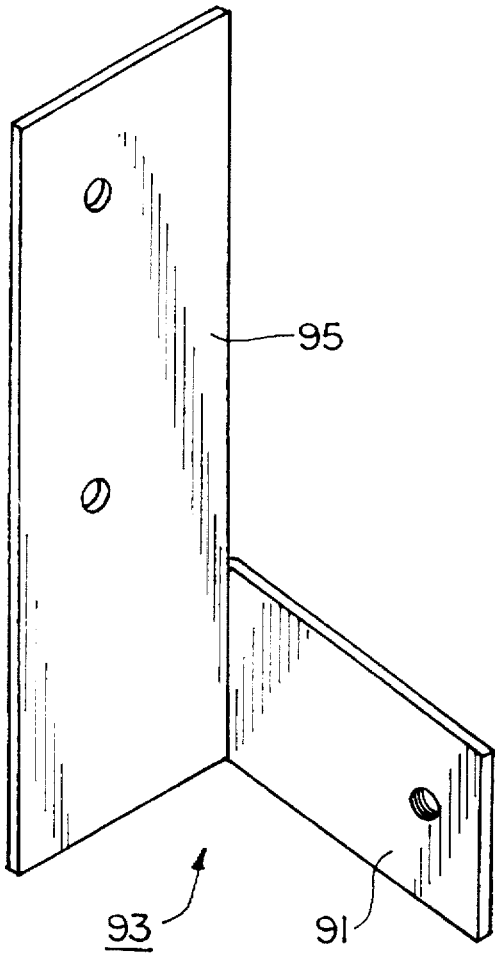
FIG. 12 is a perspective view of the interconnecting bracket shown in FIG. 7.
Figure 13:
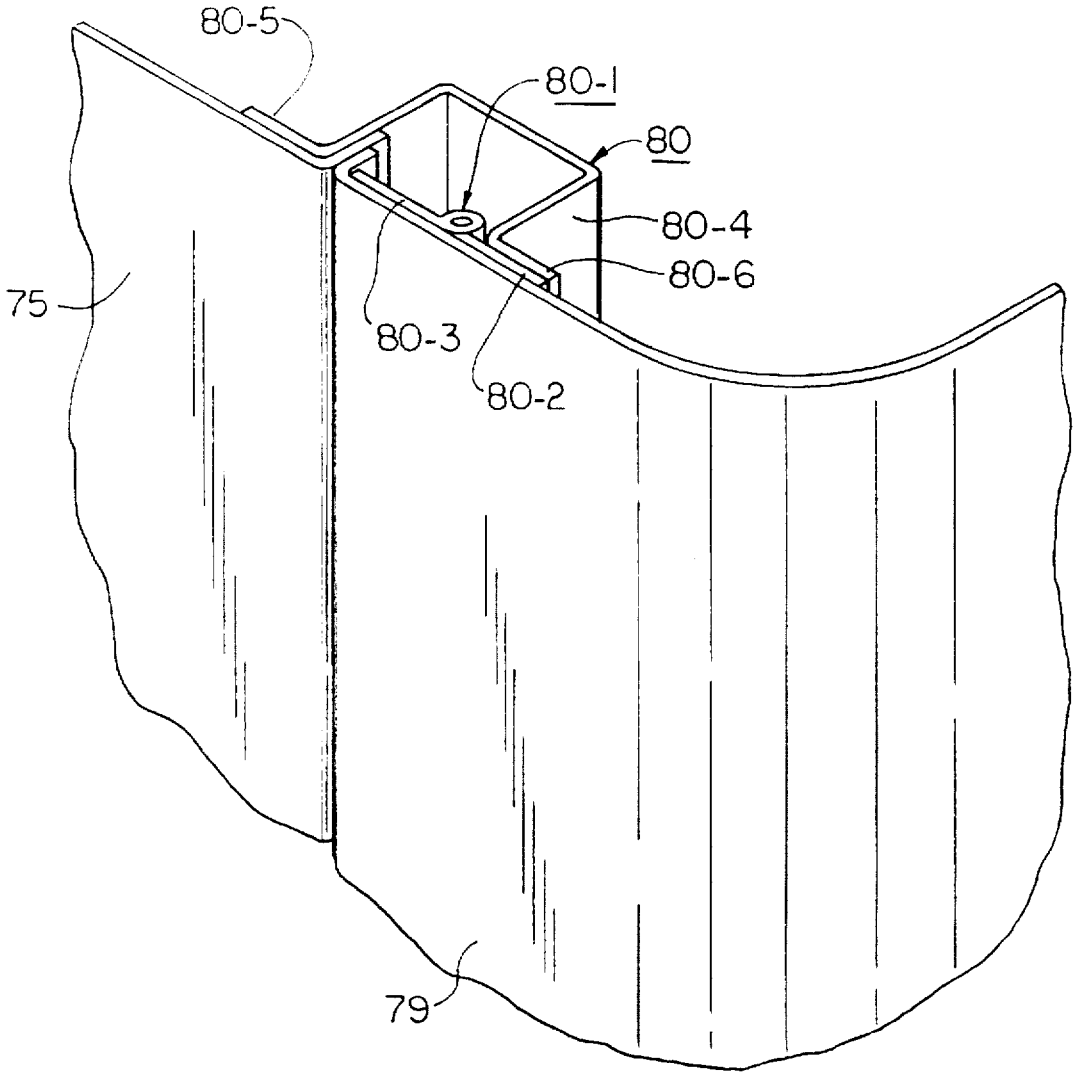
FIG. 13 is a fragmentary perspective view of a hinge assembly shown in FIG. 7.
Figure 14:
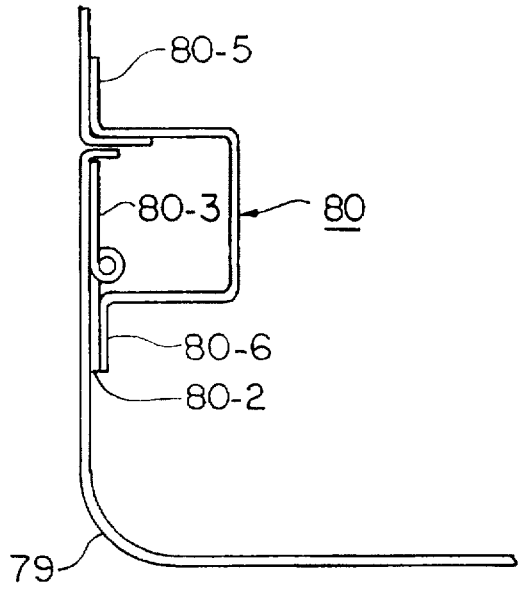
FIG. 14 is a top plan view of the hinge assembly shown in FIG. 13 when the door is in the closed position.
Figure 15:
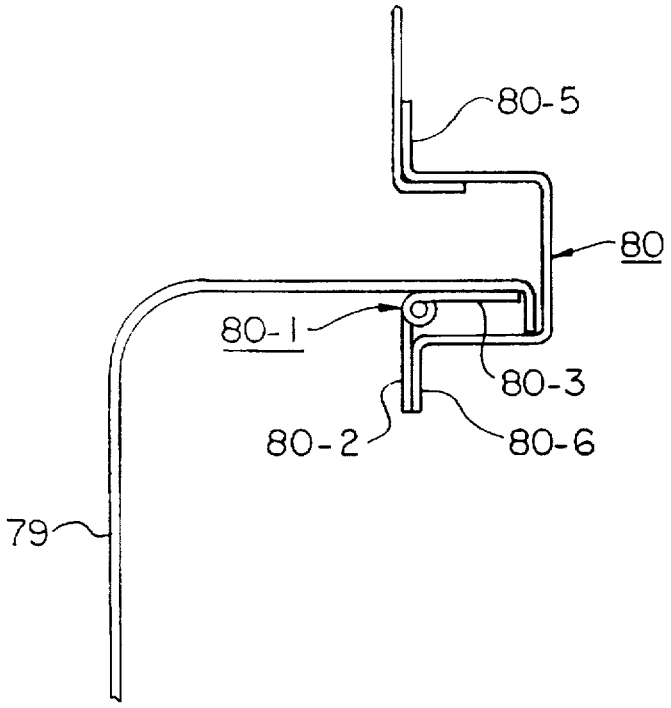
FIG. 15 is a top plan view of the hinge assembly shown in FIG. 14 when the door is in an open position.

When door 79 is closed and locked, slots 102 in bracket 101 will be positioned relative to hooks 81-1 of latches 81 as shown in FIG. 11, thereby preventing door 79 from being opened.

Figure 9:
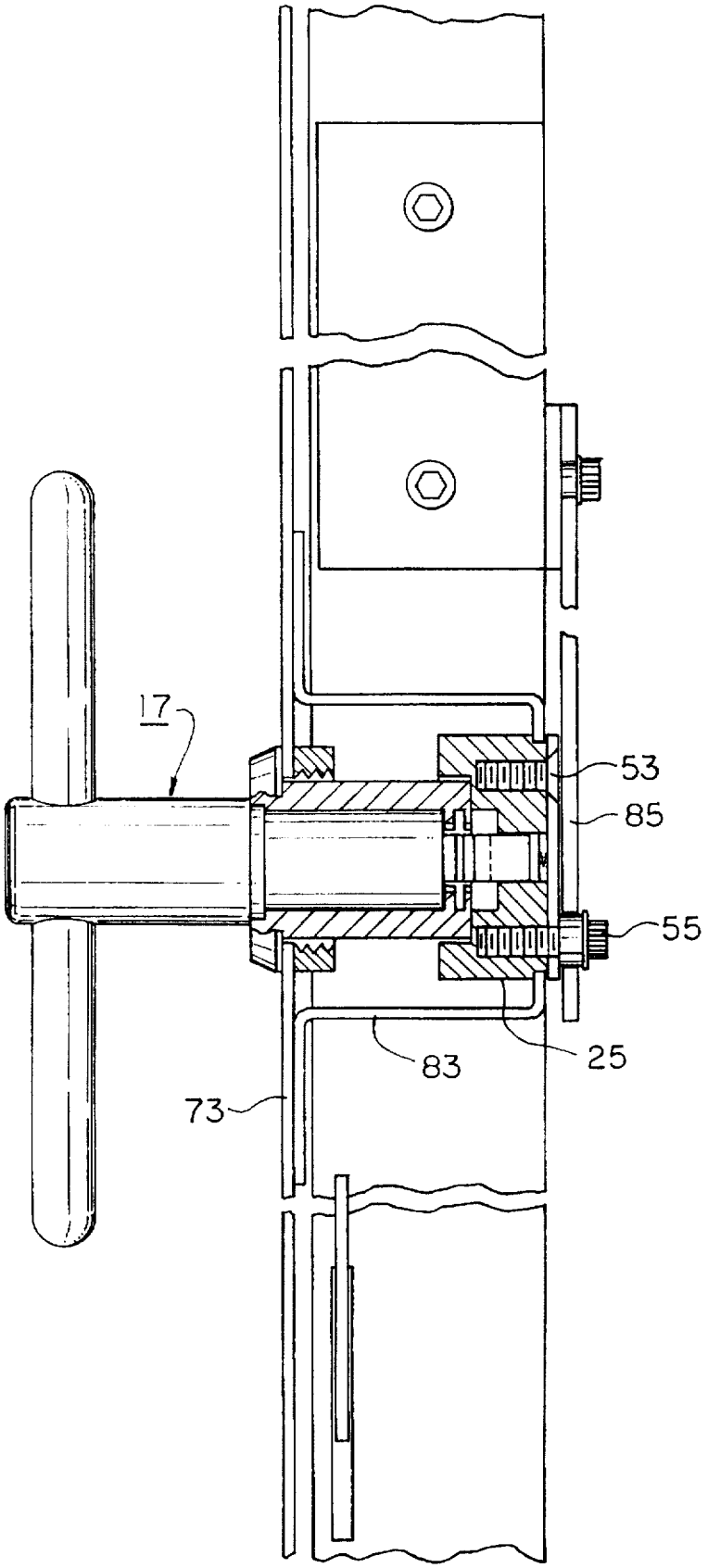
FIG. 9 is the view as shown in FIG. 8, but with the tool inserted in the shell and the cam module in a first position.
Figure 10:
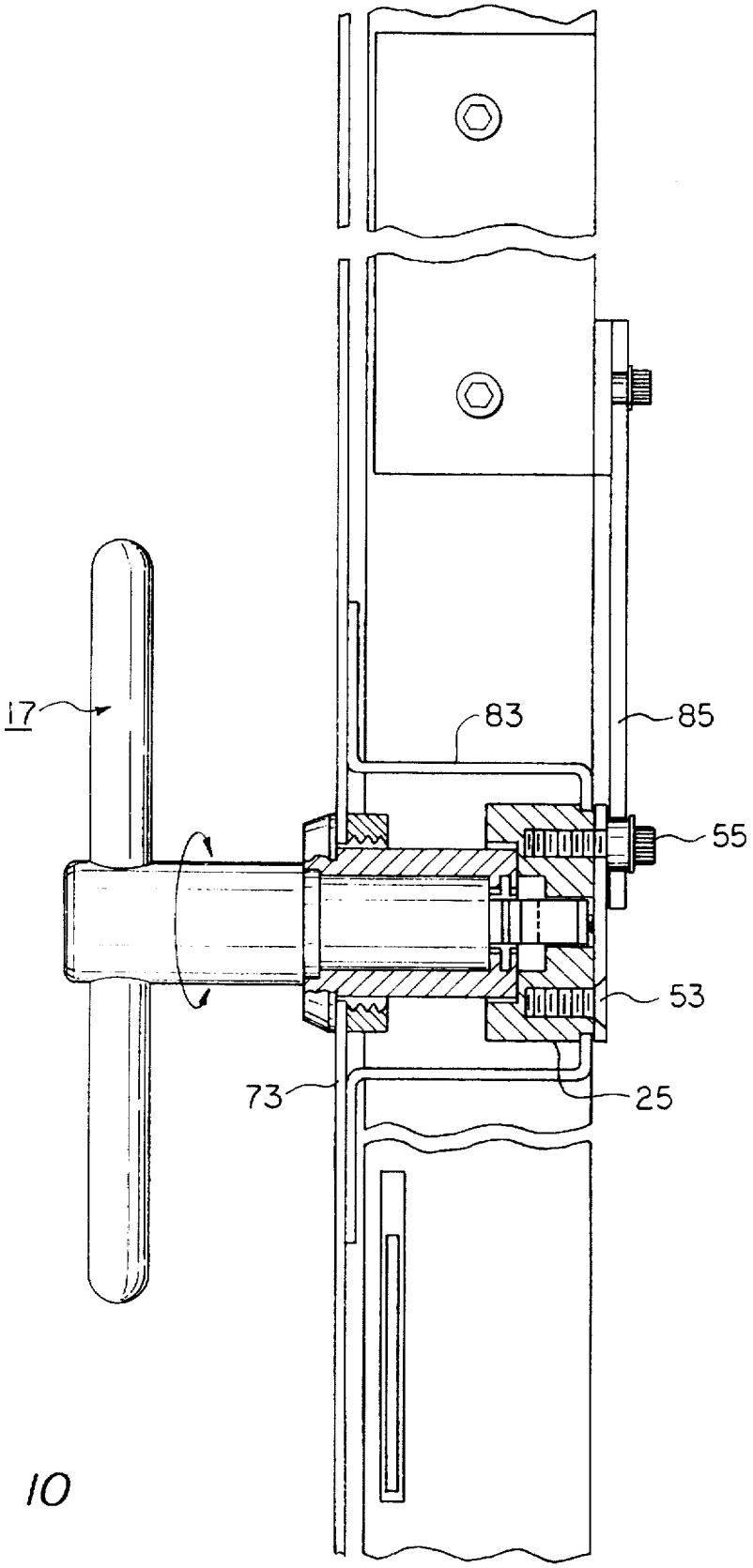
FIG. 10 is a view shown in FIG. 8, with tool inserted in the shell and rotated so that the cam module is in a second position.

When tool 17 is initially inserted through shell 19 and into cam module 25 but not turned and door 79 is closed, cam module 25, bracket 85 and bracket 101 will be as shown in FIGS. 9 and 11 with bracket 101 in a lowered position so as to prevent door 79 from opening. However, when tool 17 is rotated 180 degrees, it will rotate cam module 25 180 degrees about its axis moving bracket 85 upward, carrying with it bracket 101, as shown in FIG. 10, to a raised position so that latches 81 are aligned with slots 102 such that door 79 can be opened.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A lock assembly comprising:

a. a shell having a front end, a rear end, and a central bore extending from the front end to the rear end;

b. a key operated plug axially aligned and rotatably and removably disposed within the central bore of said shell;

c. a cam module, said cam module comprising a cam module base and a cam module bracket, said cam module base being annularly shaped and rotatably mounted on the rear end of the shell, said cam module bracket being located inside said cam module base for restricting rotational movement of said cam module base on said shell;

d. a key insertable into said plug for removing said plug from said shell; and e. a tool insertable through the central bore in said shell into the cam module when said key operated plug is removed from said shell for rotationally moving said cam module relative to said shell;

f. said cam module bracket being movably disposed within said cam module base;

g. said cam module base including a lateral slot and wherein said cam module bracket is located in said lateral slot and wherein said cam module base can rotate relative to said shell when said cam module bracket is disposed completely within said slot.

2. The lock assembly of claim 1, wherein the tool has a front end and the plug has a front end and wherein the front end of the tool is longer than the front end of the plug.

3. A lock assembly comprising:

a. a shell having a front end, a rear end, and a central bore extending from the front end to the rear end;

b. a key operated plug axially aligned and rotatably and removably disposed within the central bore of said shell;

c. a cam module, said cam module comprising a cam module base and a cam module bracket, said cam module base being annularly shaped and rotatably mounted on the rear end of the shell, said cam module bracket being located inside said cam module base for restricting rotational movement of said cam module base on said shell;

d. a key insertable into said plug for removing said plug from said shell; and e. a tool insertable through the central bore in said shell into the cam module when said key operated plug is removed from said shell for rotationally moving said cam module relative to said shell;

f. said cam module bracket being movably disposed within said cam module base;

g. wherein said shell includes a lateral slot and said bracket includes feet which are slidably movable into and out of said lateral slot.

* * * * *